US011584032B2

(12) United States Patent
Jenter

(10) Patent No.: US 11,584,032 B2
(45) Date of Patent: Feb. 21, 2023

(54) CUTTING MACHINE WITH TWO GUIDE PLATES FOR THE GUIDANCE OF BLADE AND CLAMPING BARS

(71) Applicant: Krug & Priester GmbH & Co. KG, Balingen (DE)

(72) Inventor: Holger Jenter, Balingen (DE)

(73) Assignee: Krug & Priester GmbH & Co. KG, Balingen (DE)

( * ) Notice: Subject to any disclaimer, the term of this patent is extended or adjusted under 35 U.S.C. 154(b) by 0 days.

(21) Appl. No.: 17/654,589

(22) Filed: Mar. 12, 2022

(65) Prior Publication Data

US 2022/0297328 A1 Sep. 22, 2022

(30) Foreign Application Priority Data

Mar. 17, 2021 (EP) ..... 21163044

(51) Int. Cl.
*B26D 1/08* (2006.01)
*B26D 7/26* (2006.01)

(52) U.S. Cl.
CPC ..... *B26D 1/08* (2013.01); *B26D 7/265* (2013.01)

(58) Field of Classification Search
CPC ..... B26D 1/08; B26D 7/265; B26D 7/0006; B26D 7/2628; B26D 7/025; B26D 1/085; B26D 2007/322; Y10T 83/9486; Y10T 83/8857
See application file for complete search history.

(56) References Cited

U.S. PATENT DOCUMENTS

| | | | | |
|---|---|---|---|---|
| 6,079,304 | A * | 6/2000 | Bisceglia | B28D 1/223 83/51 |
| 11,298,848 | B1 * | 4/2022 | Clark | B26D 7/22 |
| 2002/0020274 | A1 * | 2/2002 | Zscheile | B26D 7/2628 83/826 |
| 2009/0007746 | A1 * | 1/2009 | Gunn | B26D 1/08 83/558 |
| 2015/0020662 | A1 * | 1/2015 | Yamada | B26D 7/1818 83/167 |
| 2018/0200913 | A1 * | 7/2018 | Zhang | B26D 7/015 |
| 2021/0237298 | A1 * | 8/2021 | Kurebayashi | B26D 5/02 |
| 2022/0055244 | A1 * | 2/2022 | Clark | B26D 7/2628 |
| 2022/0063950 | A1 * | 3/2022 | Tanaka | B65H 35/04 |

FOREIGN PATENT DOCUMENTS

| | | | | |
|---|---|---|---|---|
| DE | 222 235 | C | 5/1910 | |
| DE | 42 06 338 | A1 | 9/1993 | |
| GB | 566 754 | A | 1/1945 | |
| JP | 2017 164865 | A | 9/2017 | |
| WO | WO-2017189201 | A1 * | 11/2017 | B26D 1/0006 |

* cited by examiner

*Primary Examiner* — Jonathan G Riley
(74) *Attorney, Agent, or Firm* — Orbit IP

(57) ABSTRACT

A cutting machine with a cutting support for material to be cut has a vertically movable, horizontal blade bar which bears a blade for cutting the cut material located thereon. A vertically movable, horizontal clamping bar is for pushing down the material to be cut. Two guide plates are arranged adjacent to one another, spaced apart in parallel in the same vertical plane, and in each case said guide plates have an inclined linear slot in which the blade bar is guided, and on the front faces thereof facing one another in each case have a vertical guide on which the clamping bar is guided.

13 Claims, 3 Drawing Sheets

CUTTING MACHINE WITH TWO GUIDE PLATES FOR THE GUIDANCE OF BLADE AND CLAMPING BARS

CROSS-REFERENCE TO RELATED APPLICATIONS

This application claims priority to European Application No. 21 163 044.7, filed Mar. 17, 2021, the entire contents of which are hereby incorporated in full by this reference.

FIELD OF THE INVENTION

The invention relates to a cutting machine with a cutting support for material to be cut, with a vertically movable, horizontal blade bar which bears a blade for cutting the cut material located thereon, and with a vertically movable, horizontal clamping bar for pushing down the material to be cut. The cut material may be, for example, a paper stack.

BACKGROUND OF THE INVENTION

Nowadays there are various functional principles in electrically driven cutting machines, both for the cut material pressing and for the blade drive. These functional principles may be partially assigned to specific machine size groups, since here they represent in each case the best compromise between function and costs.

The smaller cutting machines have a special status, since the forces required for the actuation of the cut material pressing are not particularly high in comparison with larger machines, so that often the muscular strength of the operator is sufficient and no motorized assistance is required. These machines are often not production machines operated by the operator all day long. A typical application of such machines is, for example, in copy shops. In this case, the partial or full electrification often serves primarily for greater convenience since the expenditure of force by the operator is reduced and it is also possible to work more rapidly over a long period of time. Since the small machine segment is particularly price-sensitive, the production costs for the respective functional principle are paramount here and must not be too high relative to the manual machine variant. Thus generally only simple systems of electrification are used here, in some cases only the blade drive is driven by motor. If the cut material pressing is also driven by motor, the pressing force is generally not able to be adjusted.

Cutting machines of the medium-sized machine group are very widely used, starting with professional copy shops via in-house print shops to professional print shops. These machines are particularly suitable for smaller and medium-sized paper formats which are frequently used in digital printing methods. For this reason, this medium-sized machine group has gained market importance and the required professionalism. The market increasingly requires here equipment features and working speeds which hitherto were primarily reserved for machines of the large-sized machine group. The equipment features, however, are generally not able to be implemented in the medium-sized machine group segment by the technologies of the large-sized machine group. The reasons for this are, for example, the overall size, the complexity and the price for implementing the equipment features. Machines of the medium-sized machine group are designed to be able to be operated on the standard safe-guarded single-phase power supply, since this is available virtually at all desired points of use. The energy efficiency of such machines is important for many reasons.

One reason is that, from the perspective of environmental protection and operating costs, the required energy consumption should be kept as low as possible, as in all electrically operated machines. A further reason is that the single-phase electrical wiring system of the building, which is used as desired, limits the potential power consumption and thus the capacity of the machine. In other words, the more energy-efficiently the machine operates, the more power may be used productively for the actual machine function.

For all of the described machine group sizes, it is important to implement the functional units for pressing and also those for cutting the cut material, such that on the one hand they fulfil the requirements for stability and precision, which in particular are required for a clean cut, and on the other hand as far as possible are optimal in terms of efficiency, in order to convert the power available from the standard single-phase electrical wiring system of the building as effectively as possible into a maximum pressing force or a maximum cutting force at the required pressing and cutting speed. Since at the same time a high speed of the pressing/cutting process, in the sense of a high working speed, is desired, with as far as possible high pressing and cutting forces, it is not expedient to compensate for a poor efficiency of the pressing/cutting system by a slower working speed.

In the functional principles generally used today, a not insignificant part of the energy used is used for overcoming the frictional forces in the system. These frictional forces are produced by, amongst other things, the bearing and guidance of the pressing or cutting unit. It is usual to guide the blade bar, which bears the cutting blade, at its two ends slidably between two guide plates which in turn are partially provided with sliding plates. These guide plates are generally welded to the basic machine structure and thus attached as rigidly as possible. In the case of damage to such a guide plate, this significantly impedes the repair thereof or does not permit such a repair. As an alternative to the system having a total of four guide plates, embodiments are also known in which the guidance of the blade bar is integrated in a large metal cast frame which extends in a rectangular shape around the entire cutting region. This is helpful for the required stability and precision, but increases the overall system costs significantly, does not permit a modular concept for different cutting lengths and in the case of damage leads to enormously high repair costs which are often not economically justifiable. This structural principle, therefore, is primarily reserved for the very large and very expensive machine group size, since the required stiffness of the entire structure may be more easily achieved thereby. This variant is not considered in more detail below, since it involves the additional drawbacks set forth. The sliding guides of the guide plates, on the one hand, have to be very precise in order to ensure an exact cut of the cut material, and, on the other hand, a certain clearance is required between the components which slide relative to one another. In order to ensure this in the best possible manner, it is generally necessary that, by lubricating the sliding parts, the required forces for the movement thereof are reduced. At the same time the lubrication has to avoid damage to the sliding surfaces due to direct contact of the components with one another. This lubrication generally has to be renewed and is not desirable for reasons of environmental protection, the increased maintenance effort and the risk of the soiling of the cut material by excessive lubricant.

If, as is generally usual, the blade is designed to cut the cut material with a pulling cut, the blade guidance has to guide the blade during the downward movement at an angle (typically 45°) through the cut material. This is advantageous since a simultaneously horizontal and vertical movement of the blade relative to the cut material during the cutting process leads to an improved cutting result, with at the same time reduced cutting forces. A further important factor for the blade guidance is the required operator safety. In order to minimize the risk of injury, the distance between the blade edge and the clamping bar arranged directly to the rear has to be as small as possible. A larger gap involves the risk that the operator could be injured on the exposed blade edge.

Overall, many cost-intensive components are required for implementing the required functions in the previously conventional embodiments. The four required guide plates, between which the blade bar is guided (two at each end of the blade bar) and the many additional parts for implementing the pressing functionality, might be cited as an example here. In addition to the high manufacturing costs of the four required guide plates, further drawbacks result from the previous structures, such as the possibility for adjusting the perpendicular blade orientation relative to the cut material, which is not present or is only able to be implemented with effort, but which is absolutely necessary for an accurate cutting result.

In order to implement the desired pulling cutting path in the already known machine structure, a pulling force is transmitted via a crank drive, which is driven by motor, to the connecting rod thereof, which in turn is connected to the blade bar. During the cutting process, a downwardly oriented force acts via the crank drive on the connecting rod and thus on the blade bar. In order to ensure the downward movement of the blade bar by 45°, the blade bar has to be correspondingly guided. To this end, additionally so-called guide strips are frequently attached on the guide plates at the desired angle. Additionally, the blade bar is provided with corresponding rollers which roll with the upward and downward movement thereof in a positively guided manner on the guide strips. Moreover, frequently many additional components are required for the guidance of the clamping bar, and for the blade guidance, which make the structure complicated, expensive and often even inaccurate. If the overall structure of the machine is designed such that abnormal operation is also designed to be covered, such as the blocking of the blade due to incorrect depth adjustment or cut material which is not able to be cut, this leads to further excessively bulky and thus expensive machines.

SUMMARY OF THE INVENTION

The object of the present invention, therefore, is to develop a pressing and blade guidance structure which fulfils the aforementioned requirements, whilst at the same time substantially avoids the drawbacks.

This object is achieved according to the invention by two guide plates which are arranged adjacent to one another and spaced apart in parallel in the same vertical plane and which in each case have an inclined linear slot (elongated hole) in which the blade bar is guided, and on the front faces thereof facing one another in each case have a vertical guide on which the clamping bar is guided.

According to the invention, the number of required guide plates is halved from four to two, and the two guide plates which are present undertake not only the blade bar guidance but also the clamping bar guidance. So that the desired pulling cut is achieved at the desired angle (for example 45°) relative to the horizontal, the downwardly acting force of the cutting drive acting on the blade bar has to be converted into a downwardly running movement of the blade bar corresponding to the desired angle. To this end, the guide plates have the slot guidance.

The cutting machine according to the invention provides, in particular, the following advantages:

a. Optimal costs by minimizing the number of parts required for the overall function.
b. Only two integral guide plates, which undertake all of the guidance tasks for the blade bar and clamping bar guidance, are required.
c. Precise and smooth guidance of the blade bar and clamping bar by precise guide surfaces which are all combined in the two integral guide plates.

Preferably, the blade bar is guided in the slots of the two guide plates, in each case by means of a guide unit which has an axle which is guided so as to be able to roll or slide in the slot. Particularly preferably, the axle has at least one roller, in particular a rolling bearing, which rolls in the slot. The slot forms two parallel guide surfaces, one or more rollers which are advantageously designed as rolling bearings being arranged and rolling therebetween. The rollers are received by means of the axle between the front and rear guide sub-unit. The axle receives, on the one hand, the pulling forces which are produced by the adjustable connection between the associated guide sub-units, but on the other hand also the axial loads which are introduced during the cutting process via the rollers fastened thereto. The blade bar fastened to the guide units may thus only move along the track predetermined by the parallel guide surfaces of the slots. The main reaction forces which occur when cutting the cut material are transmitted via the rollers in the slots to the guide plates, which thus serve as fixed abutments. In the case of a slidably guided axle, the axle may have at least one, for example specially coated, sliding surface element which slides in the slot.

Preferably, the guide unit has on both plate sides of the guide plate in each case an axle carrier on which the axle is fastened. In this case, the axle carrier may have, above and below the slot, rolling or sliding elements which roll or slide outside on the respective plate side parallel to the slot. The guide units are functionally divided into two and in each case consist of a front and a rear guide sub-unit. Rollers, which roll on the front or rear plate side of the guide plate, are fastened to both the front and the rear guide sub-unit. This permits a very smooth movement of the guide units. Since the blade bar is directly connected to the two guide units, this blade bar may also move very smoothly. This may be achieved in a particularly cost effective, smooth-running and virtually maintenance-free manner by the use of commercially available radial deep groove ball bearings which serve as rollers. The axle carriers on the front and rear face of the guide plates are connected together by means of the axle. The axle connection may be advantageously designed such that the distance of the axle carriers from one another may be adjusted. This adjustability permits the guide units to be able to be adapted to the guide plate thickness in a very simple and accurate manner without significant clearance between the guide plate sides, so that possible variations in the thickness of the guide plates due to manufacture may be easily compensated. In the case of an axle carrier slidably guided outside on the plate side, the sliding elements may be configured, for example, as specially coated sliding surface elements.

Preferably, the roller axles of the rollers, of those two axle carriers to which the blade bar is fastened, are displaceably mounted in a direction at right angles to the vertical plane of the two guide plates in order to adjust the inclination of the blade and the gap distance between the blade and the clamping bar. This displaceable bearing of the roller axles may be implemented in a particularly simple manner by a rotatable eccentric sleeve, the roller being rotatably mounted thereon. In order to be able to ensure the perpendicular orientation of the blade bar and thus the blade relative to the cut material, the blade bar fastened to the guide units may be adjusted in its angular position relative to the guide plates. This is implemented, for example, by means of eccentric sleeves which permit an eccentric adjustment of the roller position about the center symmetry thereof. As a result, it is possible to adjust the distance of the axle carriers from the guide plate surface on which the rollers bear. If this adjustment is not undertaken equally in the respective upper and lower rollers, an angular change is produced of the guide unit relative to the guide plate and thus the desired angular change of the blade relative to the cut material. In addition to the possibility of adjustment via the eccentric sleeve on the guide units, the cutting support on which the cut material is located may also be adjusted in its angle of inclination, so that a simple tolerance compensation of all of the tolerances to be anticipated from manufacturing is also provided here. The two plate sides of the guide plate have raceways for the rolling or sliding elements, for example in the form of guide grooves, preferably running above and below the slot, in each case parallel to the slot.

In order to be able to compensate for dimensional errors of the guide plates inside the guide surface, additionally a spring assembly is constructed on the axle, said spring assembly being clamped therewith when adjusting the axle carriers, and after the adjustment has taken place still permitting a minimum axial movement of the guide sub-units to one another. The spring assembly may be supported, for example, at one end on the axle carrier and at the other end on the one axle end of the axle.

Particularly preferably, the two guide plates above or below the slot have a through-hole, for example in the form of a second slot running parallel to the slot. The guide units have in each case a connecting element, in particular in the form of an axle which penetrates the through-hole and connects together the two axle carriers of the guide unit. In order to be able to compensate for dimensional errors of the guide plates inside the guide surface, a spring assembly is also additionally installed on the connecting element, said spring assembly being clamped therewith when adjusting the axle carriers, and after the adjustment has taken place still permitting a minimum axial movement of the guide sub-units to one another.

Since the guide plates are constructed correspondingly accurately and rigidly for the accurate blade guidance, it is also advantageous to use these guide plates for guiding the clamping bar. To this end, the front faces of the two guide plates facing one another have vertical guides, for example in the form of longitudinal grooves. The clamping bar in turn forms the counterpart which fits in the guides. Thus the clamping bar may not move further in its longitudinal and transverse direction than permitted by the predetermined clearance between the guides in the guide plates and the clamping bar. The clamping bar thus moves exactly along the predetermined vertical guide grooves.

Preferably, the cutting drive has an overload protection in the form of a detachable drive connecting rod, the detachment thereof being electrically controlled.

All of the requirements cited in the introduction may be implemented optimally with the cutting machine according to the invention described above, namely:

a. fewer complex and expensive components and thus cost-effective;
b. accurate guidance of blade bar and clamping bar;
c. smooth running of the entire system consisting of the blade bar and clamping bar guidance;
d. low maintenance due to rollers having permanent lubrication;
e. perpendicularly adjustable blade bar;
f. stable, overload-protected design of entire unit;
g. lower risk of soiling of cut material by rollers having permanent lubrication;
h. pulling cut at a desired angle;
i. minimum gap which is safe to implement between the blade bar and thus the blade and the clamping bar for greater operator safety;
j. repair-friendly structure which permits the effective replacement of damaged components.

Further advantages of the invention emerge from the description and the drawing. The features mentioned in the introduction and described in more detail below according to the invention may also be used in each case individually per se or in a plurality of combinations thereof. The embodiments shown and described are not to be understood as a definitive list but rather have an exemplary nature for explaining the invention.

BRIEF DESCRIPTION OF THE DRAWINGS

The invention is shown in the drawings and is described in more detail with reference to an exemplary embodiment. In the drawings.

DETAILED DESCRIPTION OF THE PREFERRED EMBODIMENTS

Figure 1A:
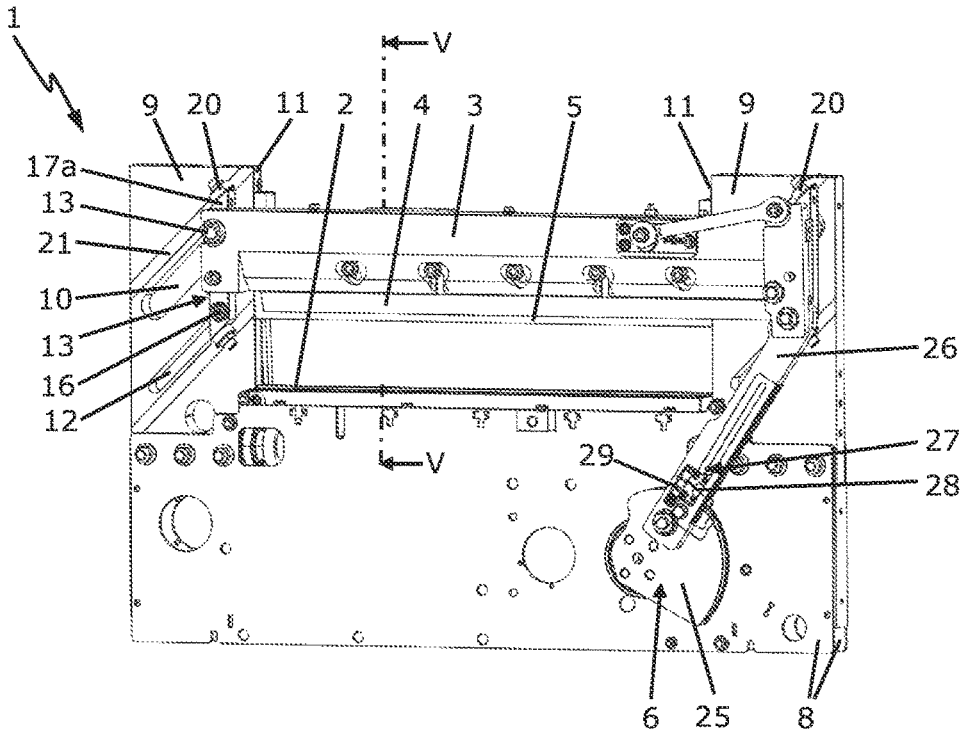
FIGS. 1*a*, 1*b* show the cutting machine according to the invention with a vertically movable blade bar and a vertically movable clamping bar in a view from the front (FIG. 1*a*) and from the rear (FIG. 1*b*)
Figure 1B:
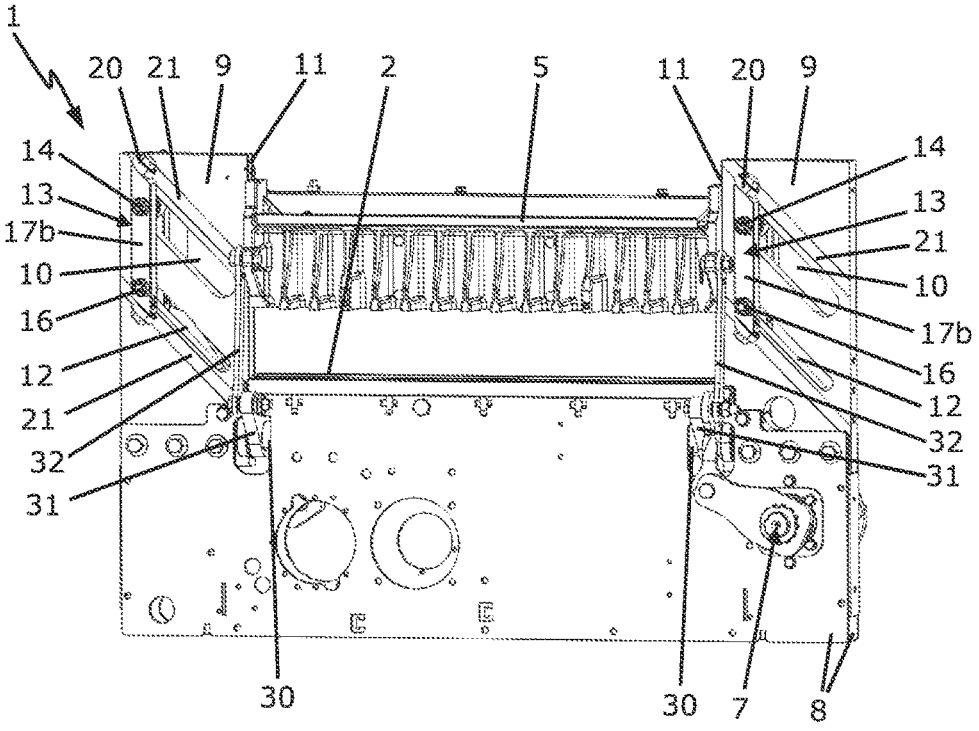

The cutting machine 1 shown in FIGS. 1*a*, 1*b* comprises a cutting support 2 for material to be cut, a blade bar 3 which is vertically movable (in this case obliquely downwardly) and which bears a cutting blade 4 for cutting the cut material located thereon, a vertically movable clamping bar 5 for pushing down the material to be cut, as well as a cutting drive 6 for vertically moving the blade bar 3 and a pressing drive 7 for vertically moving the clamping bar 5. The two drives 6, 7 in each case may be manually actuated or electrically driven.

Figure 2:
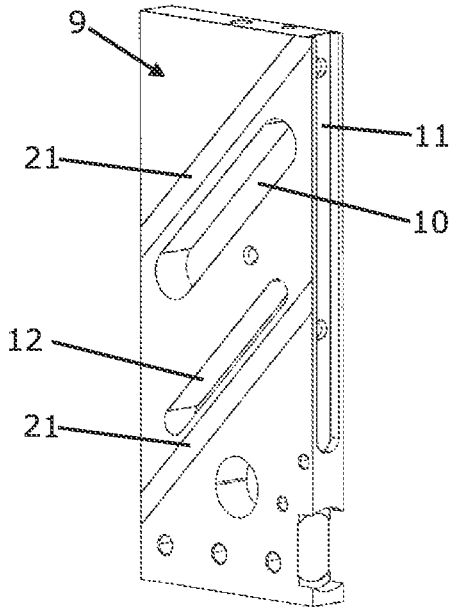
FIG. 2 shows a guide plate shown in FIG. 1 with guides for the blade bar and the clamping bar.

The cutting machine 1 is designed in a sandwich construction and has a machine base body consisting of two vertical base plates 8 between which two lateral guide plates 9, preferably of the same construction, are fastened by means of screw connections. The two guide plates 9 are arranged in parallel adjacent to one another in the same vertical plane and have, as shown in detail in FIG. 2, in each case a first linear slot (elongated hole) 10, for example inclined at 45°, in which the blade bar 3 is guided and on the front faces thereof facing one another in each case have a vertical guide 11 in which the clamping bar 5 is guided. The guide plates 9 in each case also have below the first slot 10 a second inclined linear slot 12 (elongated hole) running parallel to the first slot 10.

Figure 3:
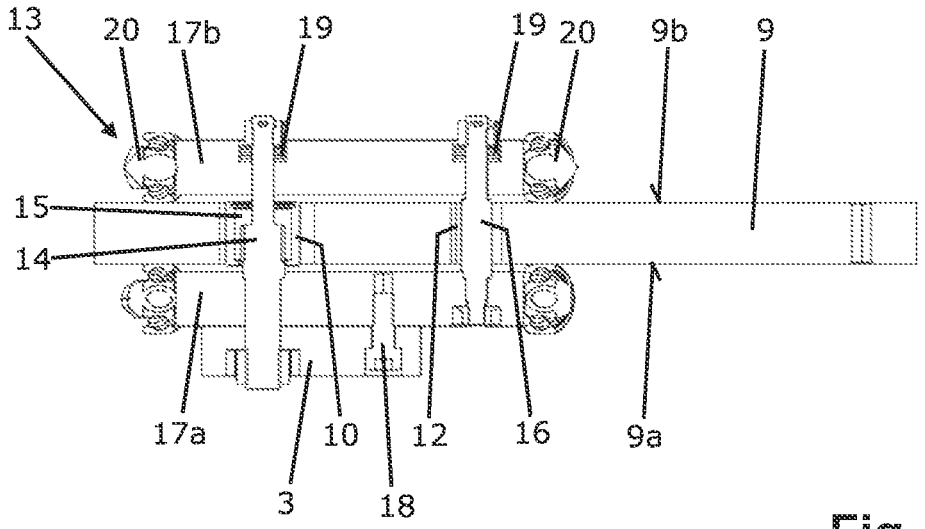
FIG. 3 shows a horizontal sectional view of a guide unit for the blade bar shown in FIG. 1.

The blade bar 3 in each case is guided in the two first slots 10 by means of a guide unit 13. As shown in FIG. 3, the guide unit 13 has a first axle 14 penetrating the first slot 10 with a rolling bearing 15, which rolls in the slot guide 10, and a second axle 16 penetrating the second slot 12. On both plate sides 9*a*, 9*b* of the guide plate 9 the guide unit 13 in each case has an axle carrier 17*a*, 17*b* on which the axle ends of the first and second axles 14, 16 are fastened. In FIG. 1*a*, the blade bar 3 is fastened to the two front axle carriers 17*a*, and namely clamped by means of the first axle 13 and screwed on by means of a screw 18. The first and the second axle 14, 16 are supported at one end on the blade bar 3 or on the front axle carrier 17*a* and at the other end are supported on the rear axle carrier 17*b* by means of a spring assembly 19.

Figure 4:
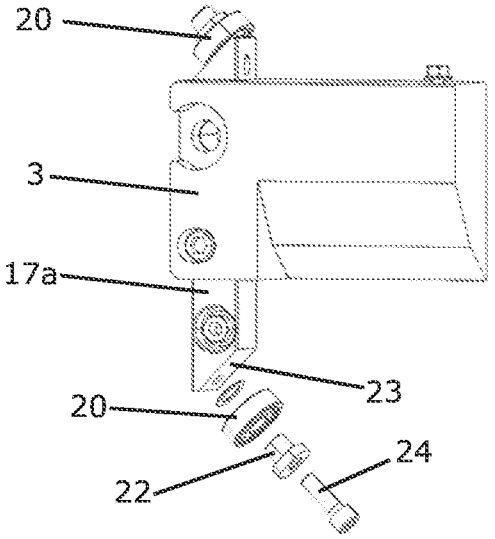
FIG. 4 shows a detailed view of the guide unit shown in FIG. 3.
Figure 5:
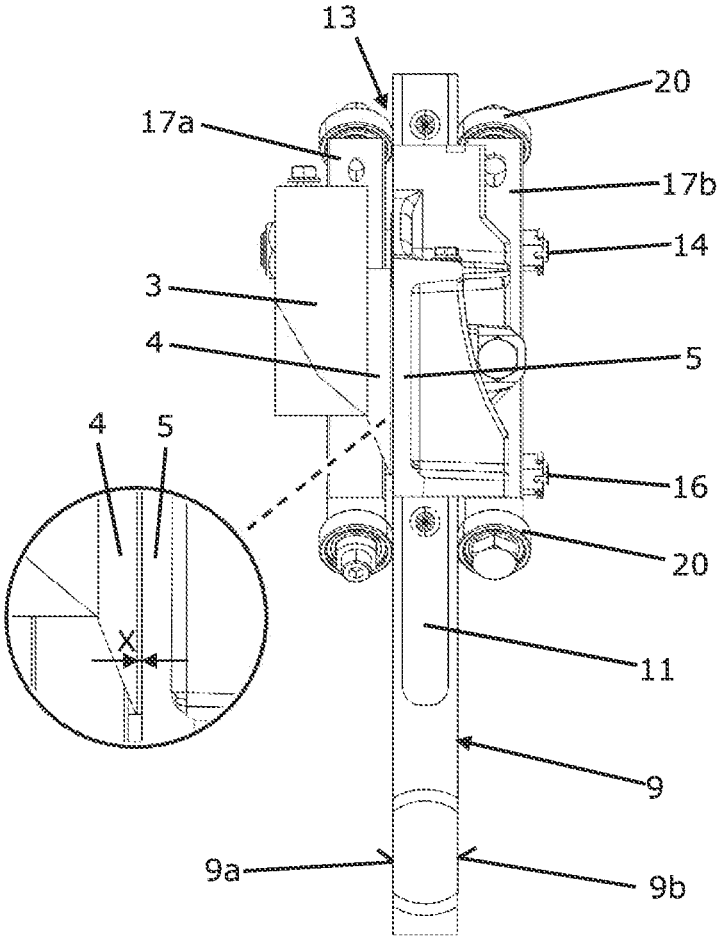
FIG. 5 shows a sectional view of the cutting machine corresponding to V-V in FIG. 1*a*.

The axle carriers 17 have above the first slot 10 and below the lower slot 12 in each case a roller 20 (for example in the form of a radial deep groove ball bearing) which rolls on the respective plate side 9*a*, 9*b* of the guide plate 9 parallel to the first slot 10, and namely on a raceway 21 machined in each case into the plate sides 9*a*, 9*b*. As shown in FIG. 4, the rollers 20 are rotatably mounted on an eccentric sleeve 22 which is screwed to an oblique surface 23 of the axle carrier 17 by means of a screw 24. As a result, it is possible to adjust the distance of the axle carriers 17 from the guide plate surface on which the rollers 20 bear. If this adjustment is not undertaken equally in each case with the upper and lower roller 20, this results in an angular change of the guide unit 13 relative to the guide plate 9 and thus an angular change to the desired perpendicular position of the blade 4 relative to the cut material and a desired gap distance X between the blade 4 and the clamping bar 5 (FIG. 5).

So that the desired pulling cut is achieved at the desired angle, the downwardly acting force of the drive connecting rod acting on the blade bar 3 may be converted into a downwardly running movement of the blade bar corresponding to the desired angle (45°).

The cutting drive 6 has a motor driven crank drive 25 in order to transmit a pulling force to a drive connecting rod 26 which in turn is connected to the blade bar 3. During the cutting process, a downwardly oriented pulling force acts via the crank drive 25 on the drive connecting rod 26 and thus on the blade bar 3. In order not to have to dimension the machine structure to be larger than is necessary for the required cutting function, a corresponding overload protection 27 is built in. This overload protection 27 is part of the drive connecting rod 26. If due to faulty operation or other reasons it leads to the abrupt blocking of the blade movement and thus to extreme load peaks in the entire machine structure, a replaceable safety part 28 is torn off or sheared off in a defined manner. This safety part 28 connects the two connecting rod halves, which in each case are connected at their end points to the blade bar 3 or the crank drive 25.

The mechanics is also designed such that whilst the drive connecting rod 26 may move apart slightly and thus be lengthened after the response of the overload protection 27 and thus after the destruction of the safety part 28, it is not entirely detached and thus the blade 4 may return into its defined safe end position. As the drive connecting rod 26 may be lengthened when the safety part 28 is destroyed, the blocking of the blade has no further influence on the running movement cycle. The cutting drive 6 and thus the entire system continue to run without load after the response, until the crank drive 25, as intended, has moved the blade bar 3 back into the safe upper end position via the drive connecting rod 26. During the second half of the cutting cycle, i.e. in reverse mode into the end position, the drive connecting rod 26 is subjected to pressure rather than tension. In the pressure direction the connecting rod length, consisting of the detached connecting rod halves, is unchanged, even after the response of the overload protection 27, which means that in reverse mode the system behaves the same with and without the overload protection 27 responding.

The response of the overload protection 27 and thus also the destroyed safety part 28 are designed to be identified immediately and not only with the next cutting cycle, by the cut material not being cut, since the drive connecting rod 26 is no longer able to transit any pulling forces. To this end, in the case of overload, parallel to the mechanical safety part 28 an electrical connection may be broken, said electrical connection for example being able to be implemented in the form of an electrical control part (for example printed circuit board) 29, and being destroyed in the manner of the safety part 28. As a result, a power circuit is interrupted, this signal change is identified by the machine controller immediately after the overload occurs, and after the completion of the running cutting cycle the machine may no longer permit any further cutting cycles. In order to set the machine back into the ready-for-operation state, the operator has to replace the destroyed safety part 28 and the also destroyed control part 29. In this case, the mechanical safety part 28 may also at the same time form the electrical control part 29. The electrical control may also be implemented by means of a switch, but very high functional reliability with at the same time low costs may be implemented by means of the mechanical destruction.

The clamping bar 5 is designed to be lowered perpendicularly onto the cut material and to fix this cut material in the desired manner, so that a clean cut may then be carried out. To this end a downwardly oriented force acts on the clamping bar 5 which is provided via the pressing drive 7. This may take place, as in the present case, by a motor which pivots via a mechanical and/or hydraulic unit a synchronization shaft 30 about its longitudinal axis by a maximum of 180°. Extension arms 31 are attached to the ends of the synchronization shaft 30 and which at their outer end are connected in an articulated manner to connecting levers 32, which in turn are mounted in an articulated manner on the clamping bar 5. If the synchronization shaft 30 now rotates, the extension arms 31 pivot in the same manner about the longitudinal axis of the synchronization shaft 30. At the start of the pressing process the extension arms 31 and thus the clamping bar 5 are in an upper position. During the pressing process, the synchronization shaft 30 rotates such that the extension arms 31, and therewith the clamping bar 5 attached via the connecting levers 32, move into a lower position. The lowermost position is reached when the clamping bar 5 is located on the cut material or on the cutting support 2 when no such cut material is introduced. If a torque is now applied to the synchronization shaft 30, this is converted into the desired pressing force which acts on the cut material. In addition to the action of the clamping bar 5 with the required downwardly oriented force, this clamping bar has to be moved perpendicularly downwardly parallel to the blade bar 3. In this case, it is very important that this takes place at a very short distance X of the clamping bar 5 from the blade 4. The requirement therefor is due to the already mentioned problem of there being a potential risk of injury for the operator on the exposed blade edge when the distance is too great. Outside the actual cutting process, which is controlled in terms of safety technology, the blade edge thus has to be covered by the clamping bar 5 located directly behind. The protective effect, however, is only optimally deployed when the gap X between the clamping bar 5 and the blade 4 is very small and the clamping bar 5 also protrudes slightly downwardly over the blade edge. An exact perpendicular guidance is required for the correct pressing of the cut material, which should not be subjected to any transverse forces during the pressing process since this could lead to slippage of the cut material stack and thus to an undesired cutting result.

Since the bearing of both the blade bar 3 and the clamping bar 5 is implemented via the same guide plates 9, there are no additional tolerances of further components to be considered, which could negatively influence the accurate guidance of the blade bar 3 and the clamping bar 5 and the distance thereof from one another.

What is claimed is:

1. A cutting machine comprising:

a cutting support for material to be cut;

a vertically movable, horizontal blade bar which bears a blade for cutting the cut material located thereon;

a vertically movable, horizontal clamping bar for pushing down the material to be cut;

two vertically disposed guide plates which are arranged adjacent to one another and spaced apart in the same vertical plane, and which each have an inclined linear slot in which the blade bar is guided, and on a front face of each guide plate facing one another is a vertical guide on which the clamping bar is guided;

wherein the blade bar is guided in the slots of the two guide plates by a guide unit which has an axle which is guided so as to be able to roll or slide in the slot; and wherein the guide unit has on both plate sides of the guide plate an axle carrier on which the axle is fastened;

wherein the axle carrier has, above and below the slot, rolling elements which roll or slide outside on the respective plate side parallel to the slot;

wherein the rolling elements are configured as rollers, which roll or slide outside on the plate side of the guide plate; and wherein roller axles of the rollers of those two axle carriers to which the blade bar is fastened are displaceably mounted in a direction at right angles to the vertical plane of the two guide plates by two rotatable eccentric sleeves, each roller being rotatably mounted on a respective rotatable eccentric sleeve, wherein rotation of the rotatable eccentric sleeves are configured to adjust the inclination of the blade and the gap distance between the blade and the clamping bar.

2. The cutting machine according to claim 1, wherein the axle of the guide unit has at least one roller which rolls or slides in the slot.

3. The cutting machine according to claim 1, wherein the two plate sides of the guide plates each have two raceways for the rolling elements, one raceway running to and above the slot and a second raceway running parallel and below the slot.

4. The cutting machine according to claim 1, wherein the axle of the axle carrier has at least one axle end which is fastened on the axle carrier by a spring which is supported at one end on the axle carrier and at the other end at the axle end.

5. The cutting machine according to claim 1, wherein the two guide plates each have a through-hole above or below the slot and the guide units have a connecting element, which penetrates the through-hole and connects together the two axle carriers of the guide unit.

6. The cutting machine according to claim 5, wherein the through-hole is formed by a second slot running parallel to the slot.

7. The cutting machine according to claim 5, wherein at least one of the two ends of the connecting element is fastened to the axle carrier by a spring which is supported at one end on the axle carrier and at the other end on the end of the connecting element.

8. The cutting machine according to claim 1, wherein the vertical guides of the clamping bar are each configured as a guide groove in which the clamping bar is guided.

9. The cutting machine according to claim 6, wherein at least one of the two ends of the connecting element is fastened to the axle carrier by a spring which is supported at one end on the axle carrier and at the other end on the end of the connecting element.

10. The cutting machine according to claim 1, wherein the rollers are radial deep groove ball bearings.

11. The cutting machine according to claim 2, wherein the rollers of the rolling element are radial deep groove ball bearings.

12. The cutting machine according to claim 5, wherein the connecting element is in the form of an axle.

13. A cutting machine, comprising:

a cutting support for material to be cut;

a vertically movable, horizontal blade bar which bears a blade for cutting the cut material located thereon;

a vertically movable, horizontal clamping bar for pushing down the material to be cut;

two vertically disposed guide plates which are arranged adjacent to one another and spaced apart in the same vertical plane, and which each have an inclined linear slot in which the blade bar is guided, and on a front face of each guide plate facing one another is a vertical guide on which the clamping bar is guided;

wherein the blade bar is guided in the slots of the two guide plates by a guide unit which has an axle which is guided so as to be able to roll or slide in the slot; and wherein the guide unit has on both plate sides of the guide plate an axle carrier on which the axle is fastened;

wherein the axle carrier has, above and below the slot, moving elements which roll or slide outside on the respective plate side parallel to the slot;

wherein axles of the moving elements of those two axle carriers to which the blade bar is fastened are displaceably mounted in a direction at right angles to the vertical plane of the two guide plates by two rotatable eccentric sleeves, each moving element being mounted about its axle on a respective rotatable eccentric sleeve, wherein rotation of the rotatable eccentric sleeves are configured to adjust the inclination of the blade and the gap distance between the blade and the clamping bar.

* * * * *